United States Patent [19]

Sadamatsu

[11] 3,936,183

[45] Feb. 3, 1976

[54] ELECTROPHOTOGRAPHIC COPYING MACHINE WITH IMPROVED CLEANING BLADE

[75] Inventor: Shigeru Sadamatsu, Tokyo, Japan

[73] Assignee: Fuji Xerox Co., Ltd., Tokyo, Japan

[22] Filed: Mar. 4, 1974

[21] Appl. No.: 447,524

[30] Foreign Application Priority Data

Mar. 9, 1973 Japan ..... 48-27165

[52] U.S. Cl. ..... 355/15; 15/256.5

[51] Int. Cl.² ..... G03G 21/00

[58] Field of Search ..... 355/15; 15/250.36, 256.5, 15/1.5; 118/637, 107

[56] References Cited

UNITED STATES PATENTS

| | | | |
|---|---|---|---|
| 3,080,596 | 3/1963 | Symbolik | 15/250.36 |
| 3,606,630 | 9/1971 | Haas | 15/250.36 |
| 3,660,863 | 5/1972 | Gerbasi | 355/15 X |
| 3,678,896 | 7/1972 | Hewith | 355/15 X |

*Primary Examiner*—Richard M. Sheer

*Attorney, Agent, or Firm*—Gerald J. Ferguson, Jr.; Joseph J. Baker

[57] ABSTRACT

An electrophotographic copying machine having a cleaning blade with a cleaning surface coated with a material having a friction coefficient less than 0.8 with respect to the surface of the photosensitive member of the machine, the blade having a tensile elasticity of 0.01 to 10 Kg/mm² and the cleaning surface thereof facing the direction of advance of the photosensitive member.

4 Claims, 2 Drawing Figures

ELECTROPHOTOGRAPHIC COPYING MACHINE WITH IMPROVED CLEANING BLADE

BACKGROUND OF THE INVENTION

Field of the Invention

This invention relates to a cleaning device for use in an electrophotographic copying machine. More particularly, the invention relates to a cleaning blade for removing charged powders adhering to the surface of a photosensitive member which is repeatedly used.

Various methods of forming static latent images have been proposed in electrophotography. For instance, there is a method comprising forming a photosensitive layer on a carrier, applying a static charge on the photosensitive layer by corona discharge in a dark place, and exposing an original to light while holding the original closely to the photosensitive layer or by projecting the original onto the photosensitive layer by means of an optical system, to thereby obtain a static latent image corresponding to the original. In order to visualize or develop this static latent image, charged toner powder is applied thereto. The development method may be the cascade development method, the magnetic brush development method, the powder cloud method or the like. In an electrophotographic copying machine of the type where the photosensitive layer is used repeatedly, the image is generally transferred onto copy paper by static transfer, roll transfer, adhesion transfer or the like. During this step, the charged powder (hereinafter referred to as "toner") is almost completely transferred onto the copy paper; however, a very small portion is left on the photosensitive layer. Since the photosensitive layer is used repeatedly, this remaining toner must be removed therefrom. For this purpose, a cleaning brush, a web, a blade or the like is usually employed. The image transferred onto the copy paper is fixed by heat treatment or by a heat roll or with an organic solvent.

The foregoing cleaning methods are unsatisfactory in some respects. More specifically, if a cleaning brush is used, hairs of an artificial or natural fiber such as rayon or Dynel are planted on the surface of a cylinder, and this cylinder is rotated, if necessary. Application of a static charge to the brush and the simultaneous action of a suction blower sucks the toner from the photosensitive layer where it is recovered in a filter bag. This method is employed quite broadly. However, since the cleaning mechanism includes a suction blower, a filter bag, a brush and the like, it is quite large. Accordingly, it fails to meet demands generally required in an office machine. Namely, it fails to meet the requirements of small size, economical cost and ease of maintenance. Further, the recovered toner is not suitable for repeated use, because a large amount of brush hair and the like is incorporated in the recovered toner.

A cleaning web is also utilized in the art. According to this method, the size of the cleaning mechanism can be made relatively small. However, a considerable amount of cleaning web paper or cloth is used. Further, it is difficult to discard the waste paper and replacement of the web occurs frequently.

A method for overcoming the above problems comprises contacting a rubbery sheet blade with the surface of the photosensitive member to thereby remove the toner remaining on the surface.

SUMMARY OF THE INVENTION

It is a primary object of this invention to provide an improve cleaning blade of the above type.

Another object of this invention is to provide a cleaning blade for use in a simple, economical copying machine.

Still another object of this invention is to provide a cleaning blade which cleans effectively and conveniently to give copies of good quality.

A further object of this invention is to provide a cleaning blade which does not turn up upon contact with the photosensitive member.

These and other objects and advantages of the invention will be apparent from a reading of the specification and claims taken with the drawing.

DETAILED DESCRIPTION OF PREFERRED EMBODIMENT

Figure 1:
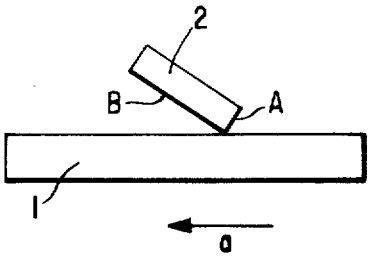
FIG. 1 is a schematic drawing of one illustrative embodiment of the invention.
Figure 2:
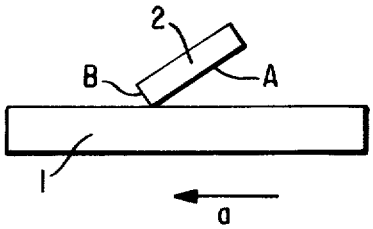
FIG. 2 is a schematic drawing of another illustrative embodiment.

Referring to FIGS. 1 and 2, a surface layer, having a friction coefficient with respect to a photosensitive substance 1 less than 0.8, is formed on a surface A of a cleaning blade 2. Surface A faces the direction *a* of advance of photosensitive member 1. Cleaning can be performed very effectively and conveniently with these blades.

As the substrate material of the cleaning blade, many ordinary plastics may be used such as polyethylene, polycarbonate, polytetrafluoroethylene, polychlorofluoroethylene, polypropylene, polyvinylidene and polyhexafluoropropylene. Rubbery materials such as natural rubber, polyurethane, neoprene, styrene-butadiene copolymers, and silicon rubber may be also used. It has also been found that good results are obtained by employing a substrate material having a tensile elasticity of 0.01 to 10 Kg/mm$^2$ measured at a temperature of 25°C and a pulling rate of 100 mm/min according to the method specified in JIS K-6871.

It has been determined that when the above substrate materials are used without the cleaning surface of this invention, unsatisfactory cleaning results. And in some cases it is necessary to incorporate in the developer toner, a lubricant such as a metal soap, e.g., zinc stearate or cadmium stearate, or a material which acts as a lubricant such as polytetrafluoroethylene and polyvinylidene fluoride.

The addition of such materials is uneconomical and an additional step is required for incorporating such additives. Further, the additive exhibits no activity for the formation of images. It is also felt that ordinary plastics such as those mentioned above can not make good contact with the photosensitive layer and thus good cleaning does not result. For reference, it is well known that a thermoplastic plastic material has a tensile elasticity of 50 to 1100 Kg/mm$^2$ as measured according to, for instance, the method specified in JIS K-6871, and a thermosetting plastic material has a tensile elasticity of 200 to 4500 Kg/mm$^2$.

Illustrative examples of cleaning blades of this invention which exhibited especially good cleaning capabilities are described below.

EXAMPLE 1

A polyurethane sheet having a thickness of 1.5 mm was cut into strips each having a width of 2.0 cm and a length of 35 cm. The cut surface was spray-coated with a laquer formed by adding 50 parts of a commercially available polyurethane varnish (solid content being 50%) to 20 parts of molybdenum disulfide, agitating the resulting mixture for 3 hours in a ball mill and diluting the mixture with a thinner. The coated surface was then dried at 80°C for 4 hours. The friction coefficient of the coated surface with respect to a selenium-vacuum-deposited surface of an aluminum plate was measured at 25°C by the test method described in ASTM D-1894-63. As a result, the value of the friction coefficient was found to be 0.3.

The above treated blade was then positioned in an electrophotographic copying machine with the treated surface facing the direction of advance of the photosensitive member. It exhibited a good cleaning capability.

In contrast, with an untreated blade, unsatisfactory cleaning was obtained, the blade turned up and contaminated copies were obtained. The tensile elasticity of the polyurethane used in this Example was 0.4 $Kg/mm^2$, and the friction coefficient of the untreated blade with respect to the surface of the photosensitive member was 1.2.

EXAMPLE 2

1 part of an epoxy resin (Epoxy Resin DER-684-EK-40 manufactured by the Dow Chemical Co.) was added to a mixture of 1 part of toluene and 2 parts of methylethylketone and the resulting mixture was spray-coated on the surface of a polyurethane rubber sheet. A commercially available paint composed of a dispersion of polytetrafluoroethylene (Tefron S 954-100) was sprayed on the coated surface, and dried and cured at 100°C for 1 hour.

When the above treated blade was tested in the same manner as in Example 1, good cleaning results were obtained.

EXAMPLE 3

75 g of a resin varnish (Oleostar M 80-50 CX) and 30 g of molybdenum disulfide powder were treated in a small ball mill for 20 hours, and the resulting dispersion was diluted with acetone. The dilution was spray-coated on the surface of a blade. The coated surface had a friction coefficient of 0.1 with respect to the surface of a photosensitive member, and the so treated blade exhibited a good cleaning effect.

EXAMPLE 4

100 g of a dispersion of a tetrafluoroethylene-hexafluoropropylene copolymer (Neofron) in an organic liquid was incorporated with 40 g of a resin varnish (Oleostar M 8-50 CX) and the resulting dispersion was coated on the surface of a blade. The so treated blade had a friction coefficient of 0.4 with respect to the surface of a photosensitive member, and exhibited a good cleaning effect.

EXAMPLE 5

A solution was prepared from 1 part of polyvinylidene fluoride (KF Polymer 1000), 0.8 parts of an epoxy resin (Million No. 1 A Clear), 0.2 parts of a curing agent, 75 parts of dimethylformamide and 15 parts of dioxane, and the solution was coated on the surface of a blade. The so treated blade exhibited a good cleaning effect.

EXAMPLE 6

A dispersion was prepared by treating for 1 hour in a ball mill having an inner capacity of 400 cc 15 g of molybdenum disulfide (Ligui Moly Neo Z Powder), 8 g of an epoxy resin varnish (Million No. 1 A Clear), 2 g of a curing agent and 100 g of a thinner. The resulting dispersion was coated on a blade and dried at 100°C for 2 hours. When the so treated blade was used for cleaning, it exhibited a good cleaning effect.

As the surface treating agent, there can be employed, for instance, inorganic substances such as molybdenum disulfide, graphite, fluorographite, boron nitride, tungsten disulfide, molybdenum diselenide, tungsten diselenide, cadmium sulfide, lead mono-oxide and lead sulfide, and organic substances such as polytetrafluoroethylene, polyvinylidene fluoride, polychlorofluoroethylene and the like.

Blades of this invention can also be prepared by forming layers containing fine powders of these substances. Polyurethane, epoxy resins, phenol resins, alkyd resins and the like can be used as a binder.

Blades of this invention can also be prepared by forming on the blade surface a coating layer with use of a solution of polyvinylidene fluoride in dimethyl phthalate. Further, they can be prepared by bonding a film of polytetrafluoroethylene, polyreinforced-trifluoroethylene, polytrifluoroethylene or polychloropropylene to the blade surface with use of an adhesive.

Surfaces treated by methods such as described hereinabove were found to have a friction coefficient of 0.01 to 1.0 with respect to, for instance, the surface of selenium, and it was found that especially good cleaning results can be obtained when the friction coefficient is less than 0.8.

All of the foregoing blade substrates, namely natural rubber, neoprene rubber, sytrene-butadiene rubber and polyurethane rubber, were found to have a friction coefficient exceeding 1.0.

It must be noted that only when, as shown in FIG. 1, the foregoing treatment is effected on the surface A facing the direction *a* of advance of the photosensitive member 1 and not on the main contact surface B of the blade 1 is the cleaning effect is improved and turning-up of blade prevented.

Of course, a good cleaning effect can be similarly obtained when selenium, selenium/arsenic, selenium/-tellurium and other ordinary photosensitive materials are used as the photosensitive member.

JIS (Japanese Industrial Standard) and ASTM (American Society for Testing and Materials), as used hereinbefore are standard references relating to the testing of materials.

What is claimed is:

1. An electrophotographic copying machine comprising a movable photosensitive layer upon which latent images are repeatedly toner developed and transferred to a receiving member, the material of said photosensitive layer being selected from the group consisting of selenium, selenium/arsenic alloy, and selenium/tellurium alloy; and cleaning blade in contact with said layer for cleaning therefrom toner not transferred to said receiving member, said blade including a cleaning layer containing materials selected from the group consisting of molybdenum disulfide, graphite, fluorographite, boron nitride, tungsten disulfide, molybdenum diselenide, tungsten diselenide, cadmium sulfide, lead monooxide and lead sulfide, polytetrafluoroethylene, polyvinylidene fluoride and polychlorofluoroethylene, polyreinforced-trifluoroethylene, polytrifluoroethylene and polychloropropylene and a substrate having a tensile elasticity of 0.01 to 10 Kg/mm$^2$, the material of said substrate being selected from the group consisting of natural rubber, neoprene rubber, sytrene-butadiene rubber and polyurethane rubber, said substrate being disposed at an angle with respect to said movable photosensitive layer, said substrate having a first side facing the direction in which said photosensitive layer moves so that said photosensitive layer moves toward said first side and a second side facing away from the direction in which said photosensitive layer moves so that said photosensitive layer moves away from said second side, said photosensitive layer being contacted substantially only by a corner of said cleaning blade comprising the intersection of said first and second sides thereof, only said first side of said substrate being covered with said cleaning layer which has a friction coefficient less than 0.8 with respect to the surface of said photosensitive layer.

2. A copying machine as in claim 1 where said cleaning layer contains binder material selected from the group consisting of polyurethane, epoxy resins, phenol resins, and alkyd resins.

3. A copying machine as in claim 1 where said photosensitive layer consists essentially of selenium.

4. In an electrophotogrphic copying machine comprising a movable photosensitive layer upon which latent images are repeatedly toner developed and transferred to a receiving member, the material of said photosensitive layer being selected from the group consisting of selenium, selenium/arsenic alloy, and selenium/-tellurium alloy, the improvement of a cleaning blade in contact with said layer for cleaning therefrom toner not transferred to said receiving member, said blade including a cleaning layer containing materials selected from the group consisting of molybdenum disulfide, graphite, fluorographite, boron nitride, tungsten disulfide, molybdenum diselenide, tungsten diselenide, cadmium sulfide, lead mono-oxide and lead sulfide, polytetrafluoroethylene, polyvinylidene fluoride and polychlorofluoroethylene, polyreinforced-trifluoroethylene, polytrifluoroethylene and polychloropropylene and a substrate having a tensile elasticity of 0.01 to 10 Kg/mm$^2$, the material of said substrate being selected from the group consisting of natural rubber, neoprene rubber, styrene-butadiene rubber and polyurethane rubber, said substrate being disposed at an angle with respect to said movable photosensitive layer, said substrate having a first side facing the direction in which said photosensitive layer moves so that said photosensitive layer moves toward said first side and a second side facing away from the direction in which said photosensitive layer moves so that said photosensitive layer moves away from said second side, said photosensitive layer being contacted substantially only by a corner of said cleaning blade comprising the intersection of said first and second sides thereof, only said first side of said substrate being covered with said cleaning layer which has a friction coefficient less than 0.8 with respect to the surface of said photosensitive layer.

* * * * *